United States Patent [19]

Fiedler

[11] 4,174,235

[45] Nov. 13, 1979

[54] PRODUCT AND METHOD OF PRODUCING SILICON-IRON SHEET MATERIAL EMPLOYING ANTIMONY

[75] Inventor: Howard C. Fiedler, Schenectady, N.Y.

[73] Assignee: General Electric Company, Schenectady, N.Y.

[21] Appl. No.: 867,987

[22] Filed: Jan. 9, 1978

[51] Int. Cl.[2] ..... H01F 1/04; C22C 38/02

[52] U.S. Cl. ..... 148/111; 75/123 A; 75/123 L; 148/31.55; 148/112; 148/113

[58] Field of Search ..... 75/123 A, 123 L; 148/31.55, 111, 112, 113

[56] References Cited

U.S. PATENT DOCUMENTS

| | | | |
|---|---|---|---|
| 3,929,522 | 12/1975 | Salsgiver et al. | 75/123 L |
| 3,932,234 | 1/1976 | Imanaka et al. | 75/123 L |
| 3,933,537 | 1/1976 | Imanaka et al. | 75/123 A |
| 3,940,299 | 2/1976 | Goto et al. | 75/123 L |
| 3,957,546 | 5/1976 | Fiedler | 75/123 L |
| 4,030,950 | 6/1977 | Shilling et al. | 148/31.55 |
| 4,054,470 | 10/1977 | Malagari, Jr. | 75/123 L |
| 4,073,668 | 2/1978 | Wieland et al. | 148/111 |
| 4,078,952 | 3/1978 | Malagari, Jr. | 148/31.55 |
| 4,113,529 | 9/1978 | Fiedler | 148/31.55 |
| 4,123,299 | 10/1978 | Fiedler et al. | 148/31.55 |

*Primary Examiner*—Arthur J. Steiner

*Attorney, Agent, or Firm*—Richard G. Jackson; Joseph T. Cohen; Paul R. Webb, II

[57] ABSTRACT

The presence of antimony improves the magnetic properties of silicon-iron. Weld brittleness is reduced in addition to improving the magnetic properties by both adding antimony and lowering the sulfur content.

11 Claims, No Drawings

PRODUCT AND METHOD OF PRODUCING SILICON-IRON SHEET MATERIAL EMPLOYING ANTIMONY

The present invention relates generally to the art of producing electrical steel and more particularly to a novel method of producing singly oriented antimony-containing silicon-iron sheet having both good weldability characteristics and excellent magnetic properties. This invention further relates to a new antimony-containing silicon-iron sheet product, which may be prepared by the method.

CROSS REFERENCE

This invention is related to the invention of Howard C. Fiedler disclosed and claimed in copending U.S. Patent Applications Ser. Nos. 837,504 (now U.S. Pat. No. 4,113,529) and 837,505, (now U.S. Pat. No. 4,123,299), each filed Sept. 29, 1977, assigned to the assignee hereof and incorporated herein by reference. The first and second-referenced applications are directed to the novel concepts of limiting the sulfur content of silicon-iron and using copper and tin, respectively, to inhibit grain growth during the final anneal, thereby reducing or eliminating weld brittleness while retaining excellent magnetic properties in the resulting products.

BACKGROUND OF THE INVENTION

The sheet materials to which this invention is directed are usually referred to in the art as "electrical" silicon steels or, more properly, silicon-irons and are ordinarily composed principally of iron alloy with about 2.2 to 4.5 percent silicon and relatively minor amounts of various impurities and very small amounts of carbon. These products are of the "cube-on-edge" type, more than about 70 percent of their crystal structure being oriented in the (110) [001] texture, as described in Miller Indices terms.

Such grain-oriented silicon-iron sheet products are currently made commercially by the sequence of hot rolling, heat treating, cold rolling, heat treating, again cold rolling and then final heat treating to decarburize, desulfurize and recrystallize. Ingots are conventionally hot-worked into a strip or sheet-like configuration less than 0.150 inch in thickness, referred to as "hot-rolled band". The hot-rolled band is then cold rolled with appropriate intermediate annealing treatment to the finished sheet or strip thickness usually involving at least a 50 percent reduction in thickness, and given a final or texture-producing annealing treatment. As an alternative practice, as set forth in U.S. Pat. No. 3,957,546 (Fiedler), the hot-rolled band is cold rolled directly to final gauge thickness.

In these boron- and nitrogen-containing silicon-irons, strong restraint to normal grain growth and thus promotion of secondary recrystallization to a precise (110) [001] grain orientation is the result of controlling the ranges of these constituents. The sulfur effective for this purpose is that which is not combined with strong sulfide-forming elements such as manganese, a presently unavoidable impurity in iron and steel. Thus, the total sulfur is necessarily greater than that necessary to provide its grain growth inhibition effect.

It is also generally recognized in the art that the presence of high total sulfur and a small quantity of boron can lead to marked brittleness in welds made in the silicon-iron alloy. Due to weld brittleness, it has not been generally possible to weld two hot rolled coils together for cold rolling, as would be a desirable operating practice, since improvements in weldability gained by reducing the sulfur content would be offset by the resulting sacrifice of magnetic properties of the alloy.

Accordingly, there is a substantial need to the art for grain-oriented silicon-iron sheet having both improved magnetic properties and good weldability.

DESCRIPTION OF THE INVENTION

It has now been found by practice of the present invention that in silicon-iron heats containing boron and nitrogen and more particularly described hereinbelow, the sulfur requirement for grain growth inhibition can be met in part through use of antimony. It has further been found that antimony does not increase weld brittleness. That is, it has now been found that heats having both (a) magnetic properties as good as or better than those associated with high sulfur content and (b) the desirable weld characteristics associated with low sulfur content can be prepared by employing such silicon-iron heats modified by including antimony and lowering the high sulfur content required for good magnetic properties in silicon-iron of the prior art. These new results can be achieved by including up to, for example, 0.10 percent or more antimony in silicon-iron alloys containing as little as 0.005 or less percent sulfur. In general, the amount of antimony required to obtain a given set of desirable magnetic properties is greater for lower sulfur content.

It has further been found by practice of this invention that magnetic properties of antimony-containing silicon-iron can be still further enhanced by applying a boron-containing coating to the decarburized silicon-iron sheet prior to heating to effect decarburization thereof and development of secondary recrystallization therein.

Generally stated, in one aspect, this invention provides a cold rolled silicon-iron sheet product comprising (i) silicon in an amount from about 2.2 to about 4.5 percent, (ii) boron in an amount from about 3 to about 35 parts per million, (iii) nitrogen in an amount from about 30 to about 100 ppm and in a ratio to boron of from about one to about 15 parts per part boron, (iv) manganese in an amount from about 0.02 to about 0.05 percent, (v) sulfur in an amount from about 0.005 to about 0.025 percent, and (vi) antimony in an amount from about 0.01 to about 0.10 percent. Higher antimony content is preferably employed with lower sulfur content.

In another aspect, generally stated, this invention provides a method which comprises the steps of (A) providing an antimony-containing silicon-iron melt of the above-described composition, (B) casting the melt and hot rolling the resulting ingot to produce a sheet-like body, (C) colding rolling the hot rolled body to provide a sheet of final gauge thickness, (D) subjecting the sheet to heat treatment to decarburize the sheet and (E) subjecting the sheet to additional heat treatment to develop (110) [001] secondary recrystallization therein.

DETAILED DESCRIPTION OF THE INVENTION

The cold-rolled sheet product of this invention may be, and preferably is, prepared by initially preparing a silicon-iron melt of the above-described composition and thereafter casting and hot rolling, preferably from about 1200° C., to intermediate thickness. Thus, the melt being cast may contain from about 2.2 to about 4.5 percent silicon, from about 3 to about 35 ppm boron, from about 30 to about 100 ppm nitrogen in the ratio range to boron of one to 15 parts to one, from about 0.02 to about 0.05 percent manganese, from about 0.005 to about 0.025 percent sulfur, and from about 0.01 to about 0.10 percent antimony, the remainder being principally iron. Small amounts of incidental impurities may be present in the melt.

After hot rolling, the resulting elongated sheet-like body or "hot band" is cold rolled to final gauge thickness. Between the steps of hot rolling and cold rolling, the hot band may be and preferably is annealed as by, for example, heat treating at 950° C. for about 3 minutes. Desirably, after final cold rolling, the sheet is decarburized as by heating in wet hydrogen at about 800° C. for about 2 minutes.

Thereafter, the resulting typically fine-grained, primary recrystallized, silicon-iron sheet product is preferably coated with magnesia for the final texture-developing anneal. Preferably, the coating step is accomplished electrolytically as described in U.S. Pat. No. 3,054,732, a uniform coating of $Mg(OH)_2$ about 0.5 mil thick thereby being applied to the sheet. Boron may be incorporated in the resulting coating in the amount and for the purpose stated above by dipping the coated strips in aqueous boric acid solution or the like.

As the final step of the process of this invention, the thus-coated sheet is heated (preferably in hydrogen) to cause secondary grain growth which begins at about 950° C. As the temperature is raised at preferably about 50° C. per hour to 1000° C., the recrystallization process is completed and heating may be carried on to up to 1175° C. if desired to aid in removing residual carbon, sulfur and nitrogen.

Practice of the present invention is further illustrated by the following non-limiting examples. All parts, percentages, and ratios given throughout this description, including the claims which follow, are by weight unless indicated otherwise.

EXAMPLE I

Five laboratory heats were melted in an air induction furnace under an argon cover using electrolytic iron and 98 percent ferrosilicon, all containing 3.1 percent silicon (Si), 0.022–0.026 percent manganese (Mn), 0.003–0.005 percent sulfur (S), less than one part or 7–10* parts per million boron (B), 41–58 parts per million nitrogen (N), 0.10 percent copper (Cu), 0.03 percent chromium (Cr) and 0.038–0.041 carbon (C). Antimony (Sb) was added in different amounts to the separate heats to provide a range of antimony content from 0.001 to 0.041 percent. Set out in Table I are the indicated approximate amounts of the indicated components of these melts, as analyzed, in ascending order of antimony content. The percentages and parts given are based on the weight of each heat.

TABLE I

| Heat | % Sb | % Mn | % S | Mn/S | ppm B | ppm N | B/N |
|---|---|---|---|---|---|---|---|
| 1 | 0.001 | 0.025 | 0.005 | 5.0 | 7.1 | 41 | 6 |
| 2 | 0.014 | 0.024 | 0.006 | 4.0 | 8.4 | 58 | 7 |
| 3 | 0.030 | 0.022 | 0.005 | 4.4 | 7.0 | 45 | 6.5 |
| 4 | 0.031 | 0.031 | 0.006 | 5.0 | Nil | 55 | Nil |
| 5 | 0.041 | 0.026 | 0.006 | 4.3 | 8.4 | 58 | 7 |

Slices 1.75 inch thick were cut from ingots cast from these melts and were hot rolled from 1200° C. in six passes to form hot bands of about 90 mils in thickness. After pickling the hot band samples were heat treated at 950° C., the time between 930° and 950° C. being about three minutes. The hot bands were thereafter cold rolled directly to about 11 mils final gauge thickness. Next, Epstein-size strips of the cold-rolled material were decarburized to less than 0.006 percent carbon by heating for two minutes at 800° C. in 20° dew point hydrogen. With 0.04 percent Sb, the carbon level after the decarburization heat treatment is approximately 0.015 percent. This leads to higher losses but does not affect permeability. Lower carbon levels and losses may be achieved through use of an annealing atmosphere of higher dew point. The decarburized strips were brushed with milk of magnesia to a weight gain of about 40 milligrams per strip. A 0.5 or 1.0 percent aqueous boric acid solution was brushed onto some of the magnesia coated strips using sufficient amounts of the solution such that if all the boron in the resulting coating were taken up by the silicon-iron, the boron content of the alloy would be increased by 12 or 24 parts per million, respectively, as indicated in Table II. The resulting coated strips, including both those brushed with the boric acid solution and those not so treated, were subjected to a final anneal consisting of heating at 40° C. per hour from 800° C. to 1175° C. in dry hydrogen and holding at the latter temperature for three hours.

Results of tests conducted on Epstein packs assembled from the strips prepared from Heats 1–5 to determine magnetic properties (energy loss and permeability) after final anneal thereof are presented in Table II.

TABLE II

MAGNETIC PROPERTIES OF HEATS 1 TO 5 AFTER FINAL ANNEAL

| | Approximate Amount of Boron Applied in Coating | | | | | |
|---|---|---|---|---|---|---|
| | 0 ppm | | 12 ppm | | 24 ppm | |
| Heat | mwpp at 17kB[a] | μ10H[b] | mwpp at 17kB[a] | μ10H[b] | mwpp at 17kB[a] | μ10H[b] |
| 1 | 1341 | 1503 | 1332 | 1506 | 1298 | 1499 |
| 2 | 1186 | 1594 | 748 | 1856 | 746 | 1844 |
| 3 | 1197 | 1621 | 746 | 1865 | 905 | 1760 |
| 4 | 1326 | 1490 | 1306 | 1496 | 1304 | 1489 |
| 5 | 1088 | 1641 | 692 | 1901 | 686 | 1900 |

[a]Energy loss in milliwatts per pound (mwpp) at 17 kilogausses (kB) of magnetic induction from alternating current at a frequency of 60 Hertz.
[b]Magnetic permeability (μ) at 10 oersteds (H)

The data show that, in general, for a given coating, losses decrease and permeability increases as the antimony content is increased, provided that the melt contains boron. (The melt for Heat 4 contained essentially no boron.) The data further show that, in general, for a given heat containing a given antimony content in the melt, application of a boron-containing coating decreases losses and increases permeability. The low losses and high permeability of the Heat 5 strips (0.041% Sb in the melt) annealed with each of the boric acid coatings are comparable to those of heretofore commercially attractive high-permeability silicon-iron. As evident from the data, the presence of as little as about 0.01 percent antimony, particularly with boron added to the coating, results in a substantial improvement in magnetic properties.

Heats 1 to 5 inclusive were evaluated for weldability by passing a fusion stripe along the length of a 5 inch-long, 65 mil-thick cold rolled strip thereof. None of these heats developed any cracks, indicating substantial freedom from weld bittleness. Laboratory heats with the same manganese content, no antimony, and containing about 0.02 percent sulfur for grain growth inhibition show extensive cracking in the same test. In greater detail, the tests yielding these results and leading to the conclusion that the occurrence of cracks is primarily dependent upon sulfur content were carried out through simulated welding which involved running a tungsten electrode (1/16-inch diameter) above (1/32 inch) the surface of the cold rolled strip clamped in a fixture. With a current of 80 amperes and electrode travel at a rate of eight inches per minute, a molten zone of 100 to 150 mils wide was obtained.

EXAMPLE 2

Two laboratory heats were prepared using the procedure of Example 1, except as herein indicated. The composition of the melts for these heats (6 and 7) was substantially the same as for Heats 2 and 5, respectively, except a higher nitrogen content was employed. Set out in Table III are the indicated approximate amounts of the indicated components of these melts, as analyzed unless otherwise indicated.

TABLE III

| Heat | % Sb | % Mn | % S | ppm B | ppm N | B/N |
|---|---|---|---|---|---|---|
| 6 | 0.014 | 0.025 | 0.005 | (10)* | 100 | (0.10)* |
| 7 | 0.038 | 0.024 | 0.003 | (10)* | 86 | (0.11)* |

*Not analyzed for boron (B). 10 ppm of boron was added in preparing the melts.

Processing from the melt stage to finally annealed condition was as described in Example 1. The approximate boron content of the coatings was varied in increments of 12 ppm from zero ppm to 60 ppm on the basis of the substrate silicon-iron sheet or strip material. Permeability and energy loss results from testing Epstein packs formed from strips of these sheets are shown in Table IV.

TABLE IV

MAGNETIC PROPERTIES OF HEATS 6 AND 7 AFTER FINAL ANNEAL

| | Heat 6 | | Heat 7 | |
|---|---|---|---|---|
| ppm B applied in coating | mwpp at 17kB[a] | μ10H[b] | mwpp at 17kB[a] | μ10H[b] |
| 0 | 865 | 1787 | 1192 | 1598 |
| 12 | 733 | 1859 | 737 | 1876 |
| 24 | 724 | 1873 | 673 | 1897 |
| 36 | 700 | 1875 | 674 | 1897 |
| 48 | 672 | 1889 | 713 | 1887 |
| 60 | 681 | 1884 | 753 | 1839 |

[a]Energy loss as defined in Table II
[b]Permeability as defined in Table II

The data again shows that the magnetic properties are improved by coating with boron, that is energy loss is reduced and magnetic permeability is increased. Moreover, this improvement increases significantly with increasing amounts of boron applied in the coating until maximum improvement is achieved. Comparison of Heats 6 and 7 shows that such maximum occurs at a higher boron addition in the coating for heats prepared from melts having higher nitrogen content. (The maximum occurs between 36 and 60 ppm boron applied in the coating for Heat 6 prepared from a melt containing 100 ppm nitrogen, while it occurs between 24 and 48 ppm boron for Heat 7 with 86 ppm nitrogen in the melt.) Comparison of the properties of Heat 6 (0.014 percent antimony coated with 12 ppm boron) with Heat 2 (also 0.014 percent antimony and coated with 12 ppm boron) shows that at lower antimony levels, higher nitrogen (100 ppm vs. 58 ppm) improves magnetic properties. This beneficial effect of increasing the nitrogen content does not obtain at the higher antimony levels employed in Heats 5 and 7.

EXAMPLE 3

Seven laboratory heats (numbers 8 to 14 inclusive) were prepared using the procedure of Example 1, except as herein noted. The compositions of the melts for these heats were substantially the same as for Heats 1–5, except for the following indicated approximate amounts of the indicated components: 0.034 percent manganese, 0.030 to 0.040 percent carbon, 10 ppm boron (added but not analyzed), 27 to 52 ppm nitrogen, 0.006 to 0.021 percent sulfur in heats including no anitmony (Heats 8–12) and 0.006 to 0.011 percent sulfur in heats including antimony (0.045 percent Sb in Heat 13 and 0.046 percent Sb in Heat 14). Set out in Table V are the indicated approximate amounts of the indicated components of each melt, as analyzed.

TABLE V

HEAT COMPOSITION AND MAGNETIC PROPERTIES

| | | | | | No B applied in coating | | B applied in coating* | |
|---|---|---|---|---|---|---|---|---|
| Heat | % Sb | % S | Mn/S | ppm N | mwpp at 17kB | μ10H | mwpp at 17kB | μ10H |
| 8 | Nil | 0.006 | 5.7 | 27 | 1344 | 1495 | 1318 | 1503 |
| 9 | Nil | 0.009 | 3.8 | 35 | 1372 | 1480 | 1326 | 1483 |
| 10 | Nil | 0.013 | 2.6 | 44 | 1381 | 1495 | 1369 | 1499 |
| 11 | Nil | 0.017 | 2.0 | 45 | 1380 | 1491 | 1299 | 1544 |
| 12 | Nil | 0.021 | 1.6 | 50 | 954 | 1774 | 758 | 1870 |
| 13 | 0.045 | 0.006 | 5.7 | 38 | 743 | 1848 | 767 | 1867 |
| 14 | 0.046 | 0.011 | 3.2 | 37 | 718 | 1878 | 719 | 1919 |

*12 ppm B applied in coating, based on weight of substrate
Note: Losses and permeability units are as given in Table II The data shows that in the absence of antimony, permeability is low until the sulfur level is increased to 0.021 percent (Heat 12). However, with 0.046 percent antimony and only 0.011 percent sulfur (Heat 14), high permeability (1878) is obtained without boron applied in the coating and higher permeability (1916) is obtained with boron applied in the coating.

Heats 8 to 14 inclusive were evaluated for weldability using the test set forth in Example 1, except that the cold rolled strips were 60 mils in thickness. This test exaggerates any tendency for a material to develop cracks. It is expected that a material which develops only transverse cracks and less than 10 such cracks per meter would be suitably weldable using well known welding procedures employing e.g., a filler and narrower molten zone. Results of the weldability tests for Heats 8 to 14 are presented in Table IV, wherein sulfur and antimony contents of these heats are also shown.

TABLE VI

HEAT COMPOSITION AND WELDABILITY

| Heat | % S | % Sb | Parallel Crack* | Transverse Cracks per meter |
|---|---|---|---|---|
| 8 | 0.006 | 0 | No | 0 |
| 9 | 0.009 | 0 | No | 0 |
| 10 | 0.013 | 0 | No | 4 |
| 11 | 0.017 | 0 | No | 63 |
| 12 | 0.021 | 0 | Yes | 200 |
| 13 | 0.006 | 0.045 | No | 8 |
| 14 | 0.011 | 0.046 | No | 4 |

*extending along substantially the entire length of the weld

The data in Table VI shows that transverse cracks increase in number with increasing sulfur content above about 0.01 percent sulfur and, in heats containing more than about 0.015 percent sulfur, transverse cracking is substantial, while parallel cracking (indicating extreme weld brittleness) occurs at about 0.021 percent sulfur. Heats exhibiting less than about 10 transverse cracks per meter in this test are expected to be suitably weldable. Although the low-sulfur containing Heats 8 to 11 exhibit a suitable degree of freedom from weld brittleness, magnetic properties thereof are sacrificed (see Table V). By comparison, the antimony-containing Heats 13 and 14 exhibit both suitable weldability (Table VI) and excellent magnetic properties (Table V).

BEST MODE CONTEMPLATED

The best mode contemplated for carrying out this invention has been set forth in the description above, for example, by way of setting forth preferred compositions and operating conditions, including but not limited to preferred ranges and values of amounts, and other unobvious variables material to successfully practicing (including making and using) the invention in the best way contemplated at the time of executing this patent application.

It is to be understood that the foregoing detailed description is given merely by way of illustration and that numerous modifications may be made therein without departing from the spirit or scope of this invention.

What is claimed is:

1. A cold-rolled silicon-iron sheet product consisting essentially of (i) silicon in an amount from about 2.2 to about 4.5 percent, (ii) boron in an amount from about 3 to about 35 parts per million, (iii) nitrogen in an amount from about 30 to about 100 parts per million and in a ratio to boron of from about one to about 15 parts per part of boron, (iv) manganese in an amount from about 0.02 to about 0.05 percent, (v) sulfur in an amount from about 0.005 to about 0.025 percent, and (vi) antimony in an amount from about 0.01 to about 0.10 percent, said amount of sulfur including an amount thereof which is not combined, the balance iron.

2. The cold-rolled sheet of claim 1 wherein the amount of manganese is about 0.026 percent, the amount of the sulfur is not more than about 0.006 percent, and the amount of antimony is at least about 0.04 percent.

3. The cold-rolled sheet of claim 1 wherein the amount of manganese is about 0.034 percent, the amount of sulfur is not more than about 0.011 percent, and the amount of antimony is at least about 0.04 percent.

4. A method of producing grain-oriented silicon-iron sheet which comprises the steps of (A) providing an antimony-containing silicon-iron melt consisting essentially of (i) silicon in an amount from about 2.2 to about 4.5 percent, (ii) boron in an amount from about 3 to about 35 parts per million, (iii) nitrogen in an amount from about 30 to about 100 parts per million and in a ratio to boron of from about one to about 15 parts per part of boron, (iv) manganese in an amount from about 0.02 to about 0.05 percent, (v) sulfur in an amount from about 0.005 to about 0.025 percent, and (vi) antimony in an amount from about 0.01 to about 0.10 percent, said amount of sulfur including an amount thereof which is not combined, the balance iron, (B) casting the melt and hot rolling the resulting ingot to produce a sheet-like body, (C) colding rolling the hot rolled body to provide a sheet of final gauge thickness, (D) subjecting the sheet to heat treatment to decarburize the sheet, and (E) subjecting the decarburized sheet to additional heat treatment to develop (110) [001] secondary recrystallization therein.

5. The method of claim 4 wherein the amount of manganese in the melt is about 0.024 percent, the amount of sulfur in the melt is not more than about 0.006 percent and the amount of antimony in the melt is at least about 0.04 percent.

6. The method of claim 4 wherein the amount of manganese in the melt is about 0.034 percent, the amount of sulfur in the melt is not more than about 0.011 percent, and the amount of antimony in the melt is at least about 0.04 percent.

7. The method of claim 4 wherein, in preparation for the heat treatment step E, the decarburized sheet is provided with an electrically insulating adherent coating containing from about 12 to about 60 parts per million boron based on the weight of the sheet.

8. The method of claim 5 wherein, in preparation for the heat treatment step E, the decarburized sheet is provided with an electrically-insulating adherent coating containing at least about 12 parts per million boron based on the weight of said sheet.

9. The product prepared by the method of claim 8.

10. The method of claim 6 wherein, in preparation for the heat treatment step E, the decarburized sheet is provided with an electrically-insulating adherent coating containing at least about 12 parts per million boron based on the weight of said sheet.

11. The product prepared by the process of claim 10.

* * * * *